US010905940B2

(12) United States Patent
Alvarez

(10) Patent No.: US 10,905,940 B2
(45) Date of Patent: Feb. 2, 2021

(54) TWO-PLAYER BASEBALL TABLE GAME

(71) Applicant: Gustavo Alvarez, Valencia (VE)

(72) Inventor: Gustavo Alvarez, Valencia (VE)

( * ) Notice: Subject to any disclaimer, the term of this patent is extended or adjusted under 35 U.S.C. 154(b) by 0 days.

(21) Appl. No.: 16/101,456

(22) Filed: Aug. 12, 2018

(65) Prior Publication Data

US 2020/0047061 A1 Feb. 13, 2020

(51) Int. Cl.
*A63F 7/06* (2006.01)
*A63F 7/24* (2006.01)

(52) U.S. Cl.
CPC ..... *A63F 7/0608* (2013.01); *A63F 7/2481* (2013.01)

(58) Field of Classification Search
CPC ..... A63F 7/0608; A63F 7/025; A63F 7/2409; A63F 7/2427; A63F 7/2481; A63B 69/40; A63B 69/407; A63D 3/02
USPC ..... 273/108.31, 108.32, 317.6–317.7
See application file for complete search history.

(56) References Cited

U.S. PATENT DOCUMENTS 861,841 A * 7/1907 Heitmann ..... A63F 7/0608 273/119 R
1,381,563 A * 6/1921 Kaufman ..... A63F 7/0608 273/108.31
3,715,122 A * 2/1973 Brown ..... A63F 1/06 273/309
4,335,701 A * 6/1982 Bozich ..... A63B 69/407 124/26
4,948,135 A * 8/1990 Follety, Jr. ..... A63F 7/0608 273/127 B
5,409,221 A * 4/1995 Cohn ..... A63F 7/0608 273/108.31

FOREIGN PATENT DOCUMENTS

FR 2435268 A1 * 4/1980 ..... A63F 7/249

OTHER PUBLICATIONS

English machine translation of FR 2,435,268 A1 (Year: 1980).*

* cited by examiner

*Primary Examiner* — Laura Davison
(74) *Attorney, Agent, or Firm* — The Iwashko Law Firm, PLLC; Lev Ivan Gabriel Iwashko

(57) ABSTRACT

A baseball table game playable by a batter and a pitcher, the baseball table game including a playing field surface, a ball launching device disposed at a first corner of the playing field surface to expel a ball therefrom toward a second corner opposite the first corner, and a batting arm holder disposed at the second corner of the playing field surface to hold an arm of the batter while the batter uses a bat to attempt to hit the ball expelled from the ball launching device.

5 Claims, 5 Drawing Sheets

TWO-PLAYER BASEBALL TABLE GAME

BACKGROUND

1. Field

The present general inventive concept relates generally to a table game, and particularly, to a two-player baseball table game.

2. Description of the Related Art

Many people enjoy watching as well as playing baseball on baseball fields but cannot duplicate that experience at home. Currently, on the market, there are various baseball board games, but most are 2D games that do not capture the thrill of real baseball. Even 3D baseball board games do not properly simulate a realistic baseball experience.

Therefore, there is a need for a three dimensional two-player baseball table game that simulates a realistic baseball experience.

SUMMARY

The present general inventive concept provides a two-player baseball table game.

Additional features and utilities of the present general inventive concept will be set forth in part in the description which follows and, in part, will be obvious from the description, or may be learned by practice of the general inventive concept.

The foregoing and/or other features and utilities of the present general inventive concept may be achieved by providing a baseball table game playable by a batter and a pitcher, the baseball table game including a playing field surface, a ball launching device disposed at a first corner of the playing field surface to expel a ball therefrom toward a second corner opposite the first corner, and a batting arm holder disposed at the second corner of the playing field surface to hold an arm of the batter while the batter uses a bat to attempt to hit the ball expelled from the ball launching device.

The playing field surface may include a backstop disposed at the second corner of the playing field surface to prevent the ball from hitting the player when the player does not hit the ball with the bat.

The playing field surface may include a plurality of primary mobile defensive units disposed about a baseball diamond portion of the playing field surface, and a plurality of secondary mobile defensive units disposed at an outfield portion of the playing field surface.

The ball launching device may include a casing having a launch channel disposed at a first end of the casing, at least one spring disposed within the casing, and a propulsive shock lever disposed within the casing and connected to the at least one spring, the propulsive shock lever including a crank disposed at a first end of the propulsive shock lever to be operated by the pitcher, such that the crank is disposed at a second end of the casing, and an end disposed at a second end of the propulsive shock lever to contact the ball to expel the ball out from the launch channel, such that the end is disposed at the first end of the casing within the launch channel.

The crank may be manipulated to alter at least one of a spin and a trajectory of the ball.

BRIEF DESCRIPTION OF THE DRAWINGS

These and/or other features and utilities of the present generally inventive concept will become apparent and more readily appreciated from the following description of the embodiments, taken in conjunction with the accompanying drawings of which.

DETAILED DESCRIPTION

Various example embodiments (a.k.a., exemplary embodiments) will now be described more fully with reference to the accompanying drawings in which some example embodiments are illustrated. In the figures, the thicknesses of lines, layers and/or regions may be exaggerated for clarity.

Accordingly, while example embodiments are capable of various modifications and alternative forms, embodiments thereof are shown by way of example in the figures and will herein be described in detail. It should be understood, however, that there is no intent to limit example embodiments to the particular forms disclosed, but on the contrary, example embodiments are to cover all modifications, equivalents, and alternatives falling within the scope of the disclosure. Like numbers refer to like/similar elements throughout the detailed description.

It is understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements and/or components, but do not preclude the presence or addition of one or more other features, integers, steps, operations, elements, components and/or groups thereof.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art. However, should the present disclosure give a specific meaning to a term deviating from a meaning commonly understood by one of ordinary skill, this meaning is to be taken into account in the specific context this definition is given herein.

Figure 1:
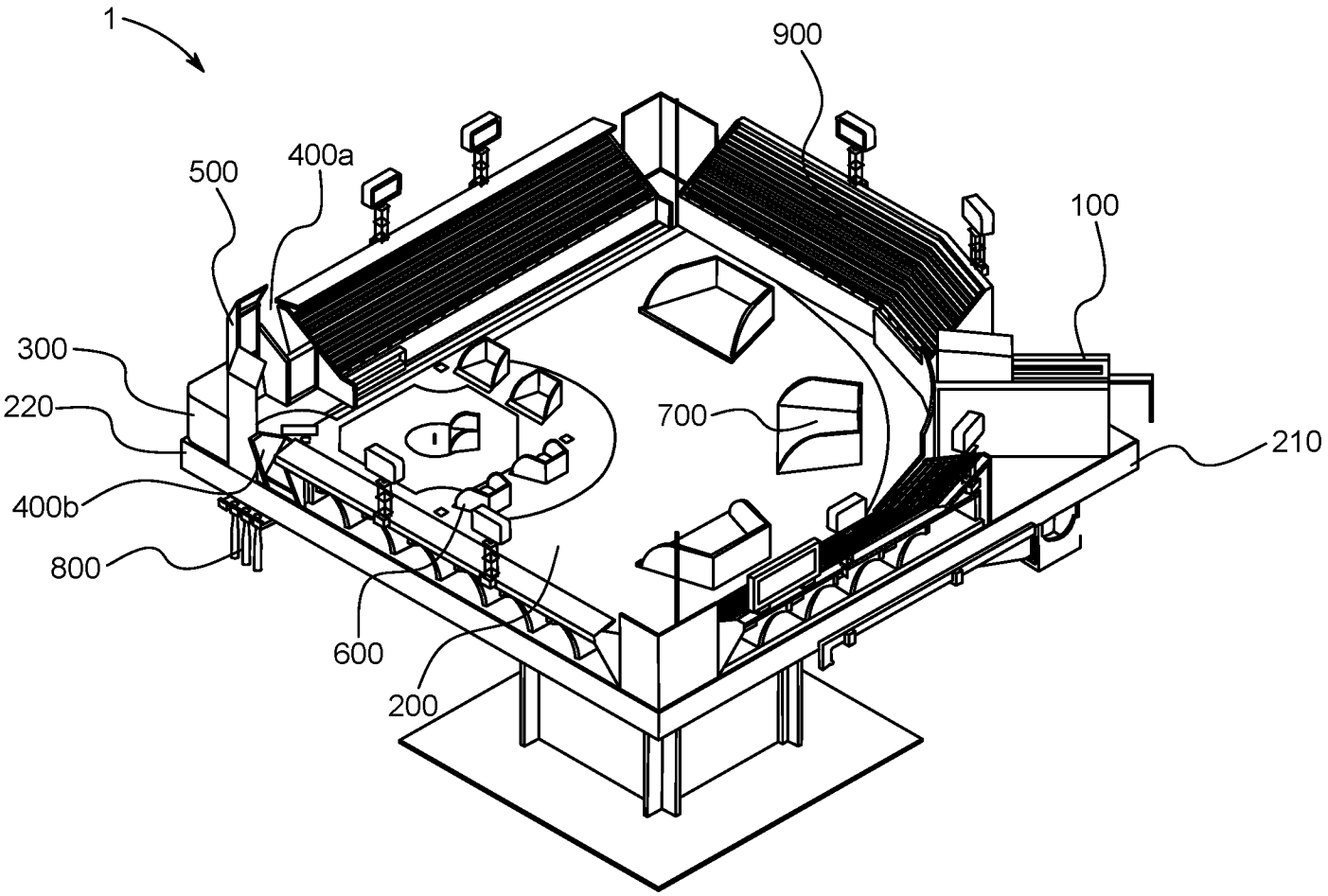
FIG. 1 illustrates a top angled perspective view of a baseball table game, according to an exemplary embodiment of the present general inventive concept.

FIG. 1 illustrates a top angled perspective view of a baseball table game 1, according to an exemplary embodiment of the present general inventive concept.

Figure 2:
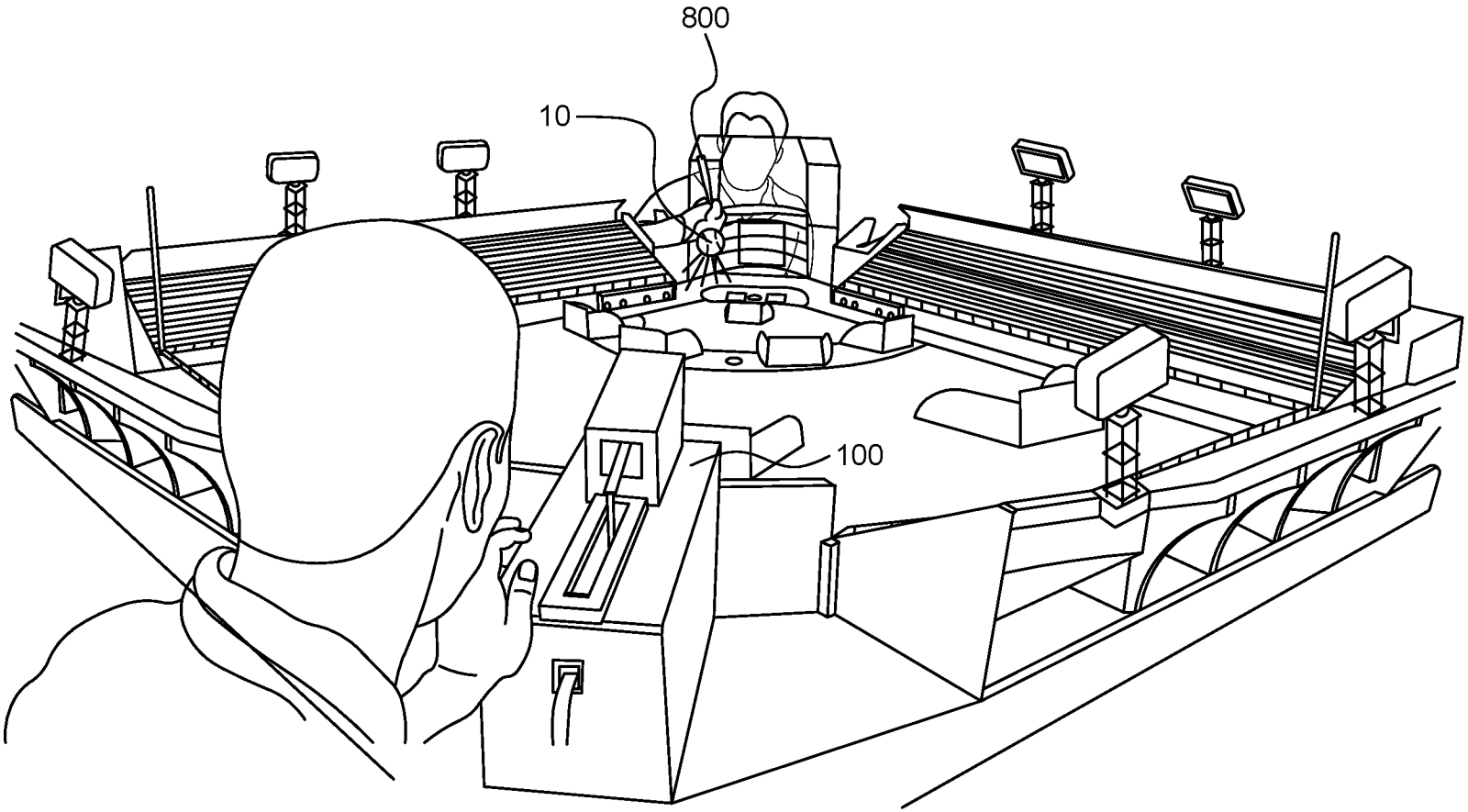
FIG. 2 illustrates another top angled perspective view of the baseball table game being played by two players, according to an exemplary embodiment of the present general inventive concept.

FIG. 2 illustrates another top angled perspective view of the baseball table game 1 being played by two players, according to an exemplary embodiment of the present general inventive concept.

Referring to FIGS. 1 and 2, the baseball table game 1 may include a ball launching device 100, a playing field surface 200, an armrest 300, a left batting arm holder 400*a*, a right batting arm holder 400*b*, a backstop 500, a plurality of primary mobile defensive units 600, a plurality of secondary mobile defensive units 700, at least one bat 800, and removable stands 900.

The ball launching device 100 may be disposed at a first corner 210 of the playing field surface 200, and may be used to launch a ball 10 toward a batter holding the bat 800 at a second corner 220 of the playing field surface 200, which is disposed opposite of the first corner 210 of the playing field surface 200.

When the batter is right-handed, for example, the batter may place a left arm on the arm rest 300 disposed at the second corner 220, and may insert a right arm into the right batting arm holder 400*b*.

Alternatively, when the batter is left-handed, for example, the batter may place the right arm on the arm rest 300 disposed at the second corner 220, and may insert the left arm into the left batting arm holder 400*a*.

The left batting arm holder 400*a* and the right batting arm holder 400*b* may be shaped and designed to comfortably hold arms of the batter.

When the ball 10 is launched toward the batter from the ball launching device 100, the backstop 500, which is disposed at the second corner 220, may stop the ball 10 from hitting the batter.

Furthermore, when the ball 10 is launched toward the batter from the ball launching device 100, the batter may attempt to use the bat 800 to hit the ball 10. As such, a real pitching/batting simulation of a baseball game may be experienced.

The playing field 200 may be designed to look like a real baseball field, and pay include small accessories such as sand, mats, a mound, plates, etc., but is not limited thereto.

The plurality of primary mobile defensive units 600 and the plurality of secondary mobile defensive units 700 may have open trapezoidal shapes that allow the ball 10 to be captured therein (or stopped thereby).

As such, the plurality of primary mobile defensive units 600 and the plurality of secondary mobile defensive units 700 may be disposed around the playing field 200 to capture the ball 10 after it is hit by the batter, such that singles, doubles, triples, and home runs may be scored.

Specifically, the plurality of primary mobile defensive units 600 may be disposed about a baseball diamond portion of the playing field surface 200, and the plurality of secondary mobile defensive units 700 disposed at an outfield portion of the playing field surface 200.

The removable stands 900 may be included to further provide a realistic baseball field feel.

Figure 3A:
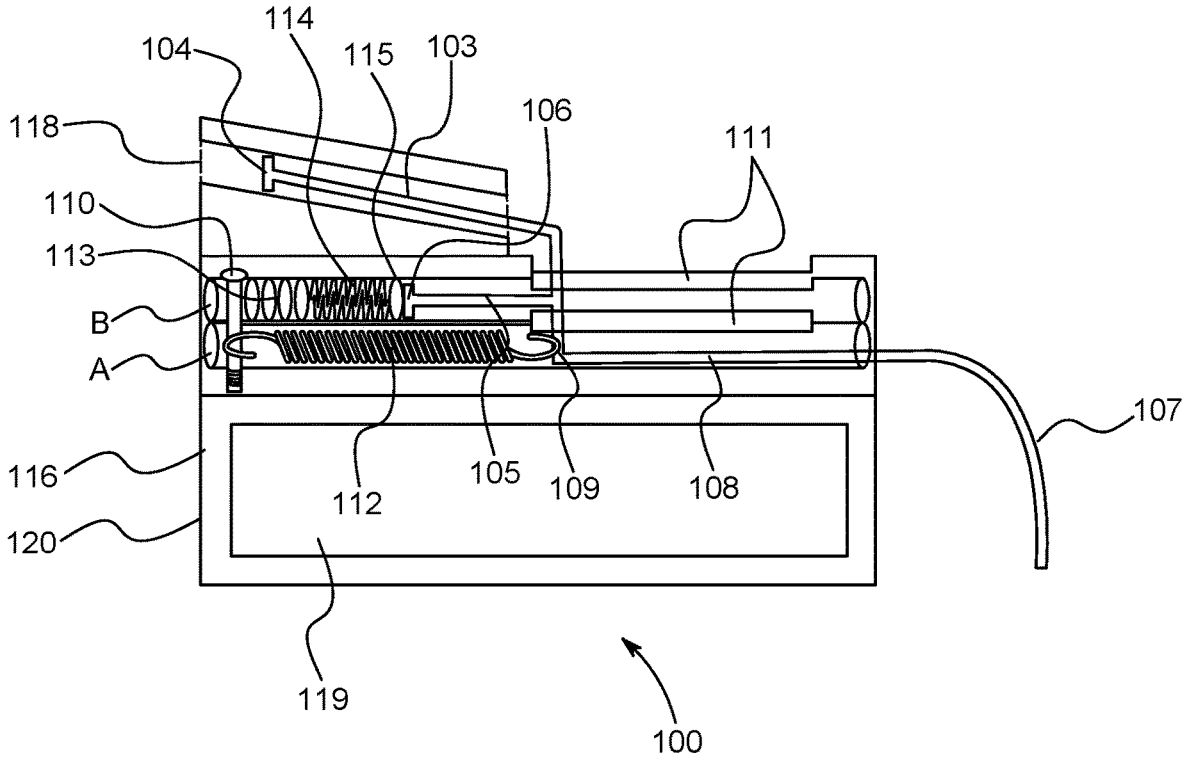
FIG. 3A illustrates a side perspective cross-sectional view of the ball launching device, according to an exemplary embodiment of the present general inventive concept.

FIG. 3A illustrates a side perspective cross-sectional view of the ball launching device 100, according to an exemplary embodiment of the present general inventive concept.

Figure 3B:
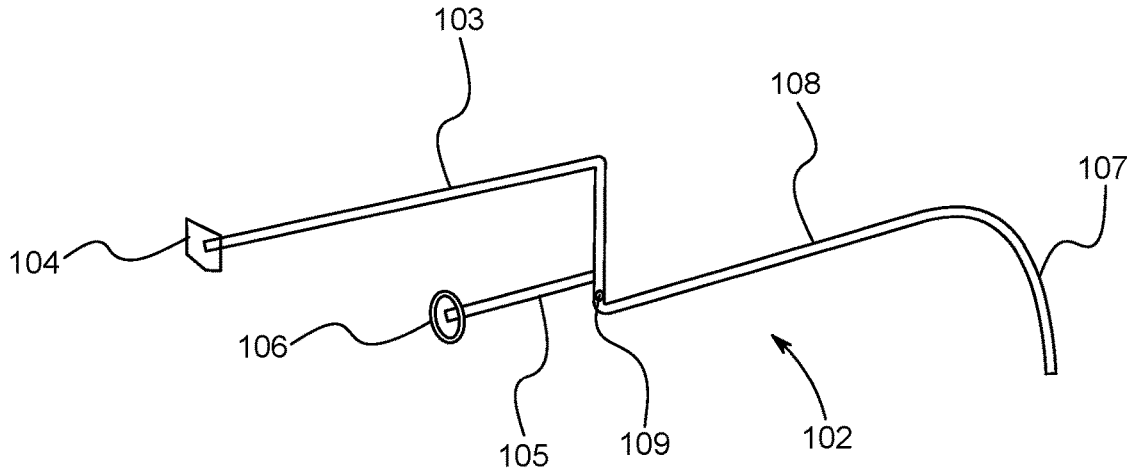
FIG. 3B illustrates a side perspective view of a propulsive shock lever, according to an exemplary embodiment of the present general inventive concept.

FIG. 3B illustrates a side perspective view of a propulsive shock lever 102, according to an exemplary embodiment of the present general inventive concept.

Figure 4:
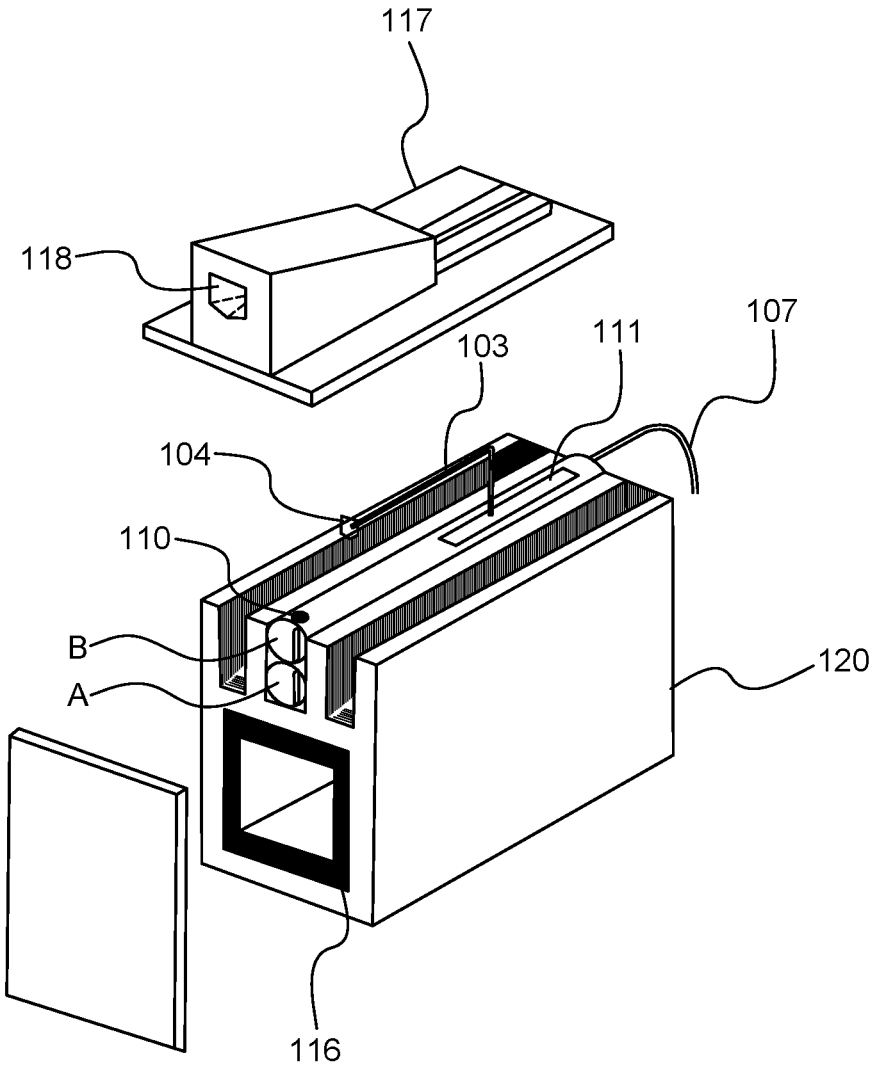
FIG. 4 illustrates a top angled perspective view of the ball launching device, according to an exemplary embodiment of the present general inventive concept.

FIG. 4 illustrates a top angled perspective view of the ball launching device 100, according to an exemplary embodiment of the present general inventive concept.

Figure 5A:
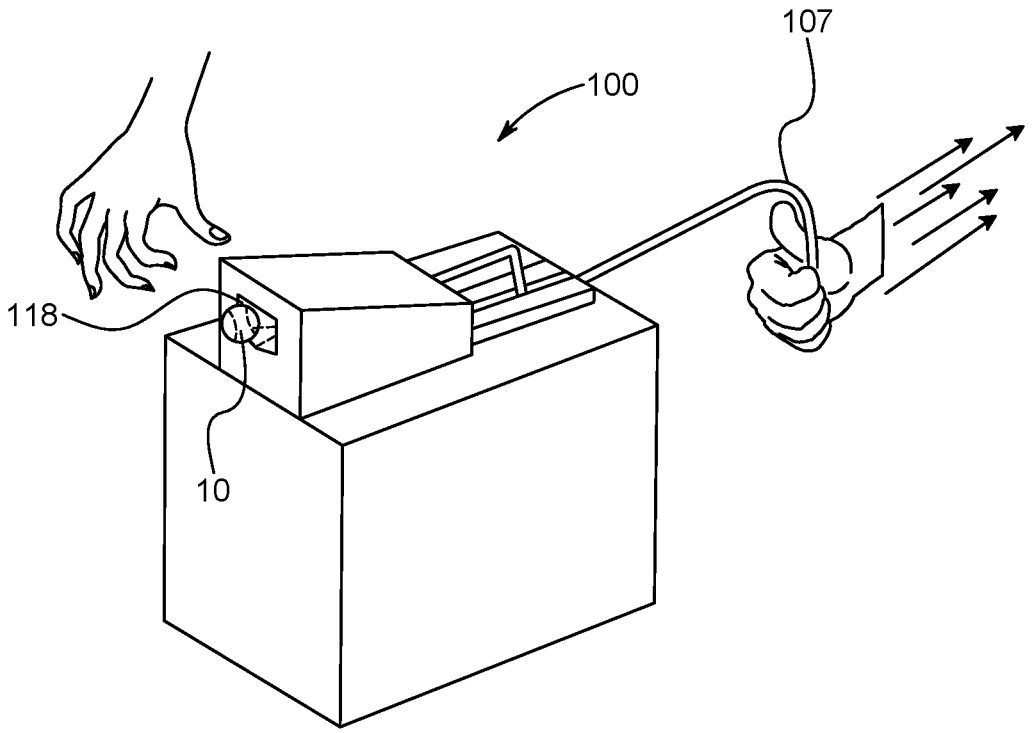
FIG. 5A illustrates a top angled perspective view of the ball launching device being loaded, according to an exemplary embodiment of the present general inventive concept.

FIG. 5A illustrates a top angled perspective view of the ball launching device 100 being loaded, according to an exemplary embodiment of the present general inventive concept.

Figure 5B:
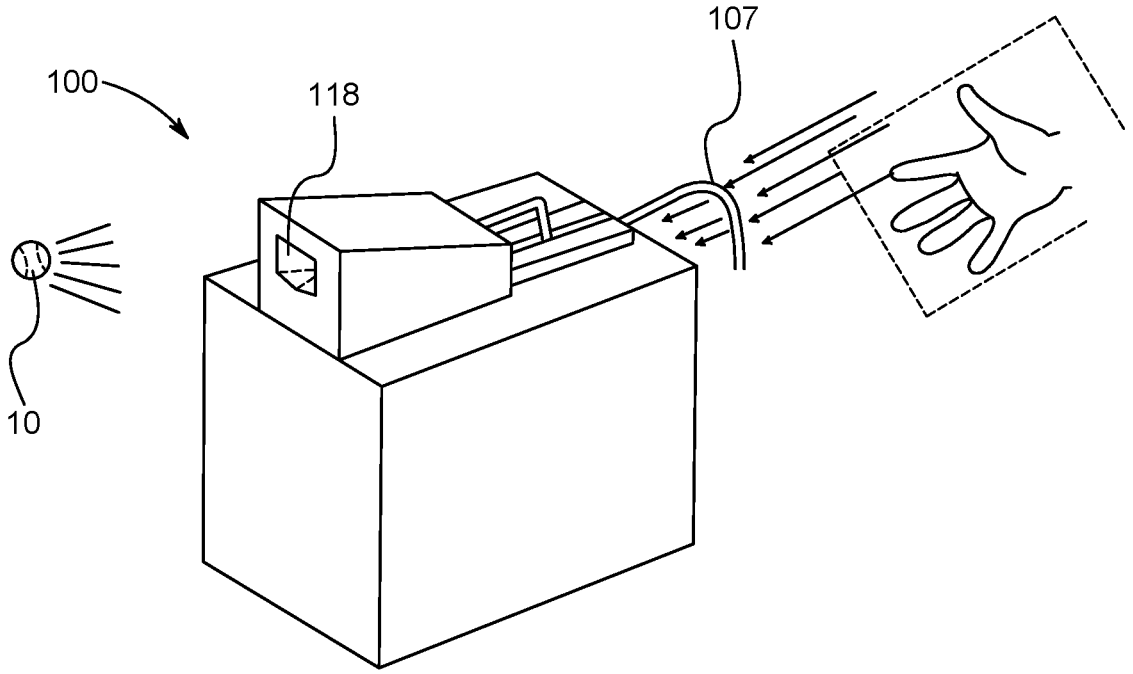
FIG. 5B illustrates a top angled perspective view of the ball launching device being shot, according to an exemplary embodiment of the present general inventive concept.

FIG. 5B illustrates a top angled perspective view of the ball launching device 100 being shot, according to an exemplary embodiment of the present general inventive concept.

Referring to FIGS. 3A through 5B, the ball launching device 100 may launch balls 10 having various rotations therefrom, and may include a plurality of components disposed within and/or about a casing 120, as described herein. A propulsive shock lever 102, in which two rods are located, namely, an upper rod 103 having a predetermined angle with respect to a horizontal plane and having a flat geometric shape top at an end 104, and a lower rod 105 that is substantially parallel to the horizontal plane and has an end 106 including a flat circular top.

The propulsive shock lever 102 may be disposed within two cylindrical lanes 111 that are joined together and attached to the casing 120 by a pin 110.

A user may use a crank 107, which is disposed at a first end of the propulsive shock lever 102 and exits out a first end of the ball launching device 100, to move an intermediate portion 108 to alter a rotational movement of a ball 10 as it is hit by the end 104 of the upper rod 103 and is launched out a launch channel 118 that is disposed at a second end of the ball launching device 100.

As such, the propulsive shock lever 102 may travel along the two cylindrical lanes 111 (a lower cylindrical lane 111*a* and an upper cylindrical lane 111*b*) that allow for a sliding of the propulsive shock lever 102.

Specifically, the lower cylindrical lane 111*a* may include a tension spring 112 that is attached at one end to the pin 110, and at another end to the propulsive shock lever 102 through a small hole 109 by which passes the end of the tension spring 112.

Additionally, the lower rod 105 of the propulsive shock lever 102 may be disposed within the upper cylindrical lane 111*b*, such that an energy dissipating system within the upper cylindrical lane 111*b* may include a plurality of vulcanized circular rubber stoppers 113 disposed at the second end of the casing 120, followed by a compression spring 114, and then another vulcanized circular rubber stopper 115 connected to the end 106 of the propulsive shock lever 102.

A cover 117 may be disposed on a top portion of the casing 120. The launch channel 118 is disposed within at least a portion of the cover 117.

Inner walls of the casing 120 may be covered with foam rubber 116 to absorb sound waves generated by the propulsive shock lever 102.

Referring to FIGS. 5A and 5B, the ball launching device 100 works when the ball 10 is introduced by the operator into the launching channel 118, then pulls the propulsive shock lever 102 by means of the crank 107, which makes its displacement through the cylindrical rails 111. When the crank 107 is released, the end 104 may hit the ball 10 to expel it through and out the launch channel 118.

Different types of rotation of the ball 10 may be achieved by movements of the crank 107 generated by the operator to make the end 106 twist, turn, and/or be placed in a different position to provide spin to the ball 10.

Referring to FIGS. 1 through 5B, after the ball 10 is launched from the first corner 210 towards the second corner 220, the batter may use the bat 800 to try to hit the ball 10 as far as possible, in order to produce a maximum score.

The present inventive concept may include a mechanical device that throws balls with different rotations, thereby emulating a scaled-down version of a pitcher-player table baseball game. This mechanical device may be manipulated by an operator (pitcher) who interacts with another player (batter) to emulate the same feel of playing a real baseball game.

The present general inventive concept may include a baseball board game that includes a collapsible base structure on which the playing field surface, removable stands, mobile defensive units, backstop and minor accessories are placed. This game may include as its main element the mechanical device to throw the ball with different rotations. This device is manipulated by an operator (pitcher) who activates the mechanism causing the ball to be ejected into a strike zone, interacting with another player (batter) who with a small bat in his hand tries to hit the ball with his forearm supported in a module specially designed for this function (armrest).

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

The invention claimed is:

1. A baseball table game playable by a batter and a pitcher, the baseball table game comprising:

a playing field surface;

a ball launching device disposed at a first corner of the playing field surface to expel a ball therefrom toward a second corner opposite the first corner, the ball launching device comprising:

a rectangular prism shaped casing, a cover disposed on a top portion of the casing to cover the rectangular prism shaped casing, a launch channel disposed within at least a portion of the cover to receive the ball therein, a plurality of cylindrical lanes disposed within at least a portion of the casing, such that each of the plurality of cylindrical lanes extends a length of the casing, such that each of the plurality of cylindrical lanes is disposed in parallel and adjacent to another of the plurality of cylindrical lanes, a propulsive shock lever disposed within the plurality of cylindrical lanes and the launch channel to contact the ball to expel the ball out from the launch channel, such that the propulsive shock lever travels along each of the plurality of cylindrical lanes in response to being pulled; and a batting arm holder disposed at the second corner of the playing field surface to hold an arm of the batter while the batter uses a bat to attempt to hit the ball expelled from the ball launching device.

2. The baseball table game of claim 1, wherein the playing field surface comprises:

a plurality of primary mobile defensive units disposed about a baseball diamond portion of the playing field surface; and a plurality of secondary mobile defensive units disposed at an outfield portion of the playing field surface.

3. The baseball table game of claim 1, wherein the ball launching device further comprises:

at least one spring disposed within the rectangular prism shaped casing.

4. The baseball table game of claim 1, wherein the propulsive shock lever comprises:

a crank disposed at a first end of the propulsive shock lever to be operated by the pitcher; and an end disposed at a second end of the propulsive shock lever to contact the ball to expel the ball out from the launch channel.

5. The baseball table game of claim 4, wherein the crank may be manipulated to alter at least one of a spin and a trajectory of the ball.

* * * * *